US005883469A

United States Patent [19]

Noll et al.

[11] Patent Number: 5,883,469

[45] Date of Patent: Mar. 16, 1999

[54] HALOGEN LAMP WITH AN INHERENT SAFETY EFFECT

[75] Inventors: Thomas Noll, Kipfenberg; Roland Stark, Wellheim; Josef Bauer, Walting, all of Germany

[73] Assignee: Patent-Treuhand-Gesellschaft fuer elektrische Gluehlampen mbH, Munich, Germany

[21] Appl. No.: 843,523

[22] Filed: Apr. 18, 1997

[30] Foreign Application Priority Data

Apr. 19, 1996 [DE] Germany ..... 296 07 132.3 U
Nov. 20, 1996 [DE] Germany ..... 296 20 098.0 U

[51] Int. Cl.[6] ..... H01K 1/18
[52] U.S. Cl. ..... 315/58; 313/579
[58] Field of Search ..... 315/58; 313/315, 313/579

[56] References Cited

U.S. PATENT DOCUMENTS 4,079,283 3/1978 George ..... 313/315 X
4,081,708 3/1978 Notelteirs ..... 313/315 X
4,132,922 1/1979 Newton et al. ..... 315/73
4,354,137 10/1982 Martin et al. ..... 313/315 X
5,146,134 9/1992 Stadler et al. ..... 313/579
5,412,542 5/1995 Mandy ..... 362/20

FOREIGN PATENT DOCUMENTS

0113445A3 12/1983 European Pat. Off. .
0161700 11/1985 European Pat. Off. ..... 313/315
3110395A1 4/1982 Germany .
9102566.4 5/1991 Germany .

*Primary Examiner*—Robert Pascal
*Assistant Examiner*—Justin P. Bettendorf
*Attorney, Agent, or Firm*—Carlo S. Bessone

[57] ABSTRACT

Halogen bulb without additional safety device for high-volt/intermediate-volt operation with a bulb pinched on one side produces an inherent safety effect by producing a current lead segment that is pinched from an uncoiled wire with a diameter of 130 $\mu$m at most and the distance between the two current leads is suitably selected.

10 Claims, 3 Drawing Sheets

HALOGEN LAMP WITH AN INHERENT SAFETY EFFECT

BACKGROUND OF THE INVENTION

The invention concerns a halogen lamp. Such a halogen bulb is known from U.S. Pat. No. 4,132,922. In the case of these lamps, under certain circumstances, an arc discharge can occur between two adjacent current leads, due to the high operating voltage (approximately 110 to 240 V). The current leads and particularly the foils can heat up so intensely by this that the adjacent pinch seal can no longer sufficiently draw off the heat. In the final stage, this can lead to the explosion of the bulb. The lamp therefore contains an inherent safety device in the form of a U-shaped wire loop, which is embedded in the pinch seal by means of an additional foil.

Another halogen bulb with inherent safety device is known from DE GM (Utility Model) 91-02,566. Here the current leads consist of singly coiled segments, which are embedded in the pinch seal, whereby their core region leaves a slinky hollow space, which acts as a blowout channel for the case when an arc forms. However, it is a disadvantage that in the pinch process, care must be taken that the hollow space is reliably formed.

Another solution to this problem is proposed in DE OS (Unexamined) 3,110,395, i.e., to provide an additional so-called heat safety device in the pinch region of a halogen bulb that is pinched on one side or on two sides. Essentially, this is a hollow space, which is left open in the region of the pinch seal and through which the inner current lead is guided over part of its length. If the current lead is not embedded in the glass, it will very quickly heat and melt through. However, this method is very expensive, since a pinch seal with a hollow space left open can be manufactured only in a very complicated way. This technique is also not applicable in the case of small lamps, since the hollow space that is left open would require too much space. For lamps pinched on one side, for reasons of stability, only one of the two current leads can be equipped with this heat safety device, so that the production of the pinch seal is very complicated.

SUMMARY OF THE INVENTION

It is the task of the invention, for a halogen bulb according to the preamble of claim 1, to simplify the manufacture and to assure a high operating safety of this lamp.

This task of the invention is resolved by the characterizing features of claim 1. Particularly advantageous embodiments are found in the subclaims.

The special value of the invention lies in the fact that an extremely reliable safety device can be obtained without additional special measures, and this device can also be very simply manufactured. With a suitable selection of the dimensions of the inner current lead and the geometry in the region of the pinch seal, any type of arcing will be reliably extinguished.

Arcing occurs due to a short circuit between parts of the coil. The latter is frequently caused by contacts between two legs of the coil (primarily in the case of U or V-shaped bent light units) or by breaking of the coil wire, each time during lamp operation. Another cause is the burning through of the coil at a critical thin spot (hot spot) at the end of the service life, which happens for the most part during the switching-on process. The coil material can be partially burned off and subsequently cause an arcing between the two current leads along the edge of the pinch. Thus such high temperatures can occur in the pinch seal that the lamp will explode.

A reliable extinguishing of the arcing can be obtained with the following arrangement: at least one of the inner current leads must not be a thick wire, but shall have at most a diameter of 130 $\mu$m. The invention is thus suitable for lamps of intermediate voltage, where wire diameters between 100 and 130 $\mu$m are frequently used. It is particularly well suitable for high-volt lamps with the use of wires that are less than 80 $\mu$m thick.

It has been demonstrated that in such a thin, completely pinched wire, the extinction mechanism is based on the fact that a part of the wire material is vaporized in the pinch seal, and leaves a free capillary space with the diameter of the current lead. The discharge first burns in this capillary. Starting from an effective length of the free capillary of approximately 2 mm, the losses of the discharge plasma due to recombination on the wall of the capillary, however, becomes so high, that the discharge is brought very rapidly and automatically to extinction. This mechanism operates within a time on the order of magnitude of less than 2 ms, thus within a fraction of a half-wave of the usual alternating frequency (50 to 60 Hz) of the mains. This narrow capillary also causes the fact that the high current density of 500 A and more that is usual for a typical arcing cannot be obtained. The discharge is thus not only weak in current, but is also limited in time and in current. It is extinguished at the latest upon reaching the zero passage. A re-ignition of the arcing in the following half-wave of the alternating current is practically excluded, since, as is known, discharge conditions that are more favorable than in the case of the first ignition would be necessary.

A specific advantage of an uncoiled wire in comparison to a single coil also lies in the fact that the mass of the current lead formed therefrom is essentially smaller with the same length embedded in the pinched seal. The evaporation of the wire material in the capillary thus proceeds essentially more rapidly. The arc is extinguished earlier and the response time of the inherent safety device is essentially shorter than for other safety devices. In addition, the energy introduced in the arcing is considerably smaller.

Under the term "uncoiled wire" is to be understood in the following a wire, which has been coiled singly initially, which, however, has been pulled out, so that a longitudinal-pulled spirally wound wire is formed. The increase is typically 10 to 100 times the wire diameter. The wire then has still not completely lost its initial spiral form, but the coils are pulled so far apart, that in contrast to the state of the art, a slinky hollow space is no longer formed in the pinch. With the same pinched length of the inner current lead, the actually accommodated wire length is thus clearly longer than in a completely uncoiled wire piece, in which the actually accommodated wire length is identical to the pinched wire length.

In order to assure a reliable response of the safety device, the minimum length of the inner current lead in the pinch seal amounts to 2 mm. Generally, this length amounts to between 2 and 4 mm.

The application of the above-described extinction mechanism is then meaningful, if the distance d between the current leads and the applied voltage V cooperate such that in the case an arcing occurs, the field strength V/d operating there is higher than 100 V/cm. In case of the lamps of the invention, the field strength lies for the most part between 200 and 400 V/cm. For lamps with a smaller field intensity, it is not necessary to have this type of safety device, since in that case the arc is reliably extinguished by other mechanisms.

Typical values for the distance between the two current leads are 5 to 8 mm.

With the lamp of the invention, in particular, extremely small structural lengths of 75 mm and less can be obtained, independent of whether a bayonet mount or a screw base is used. A particularly short structural length on the order of magnitude of 60 mm can be obtained for use of a bayonet mount, since here there is no limitation of the reduction in the minimum length as must be considered for a screw threading.

The effect of the safety device according to the invention is thus more rapid and reliable than for an extra slinky type of hollow space that is left open.

The inner current lead preferably has a diameter of more than 15 $\mu$m. Frequently the lighting unit and the inner current lead can be produced from a single wire as a unit, i.e., the inner current leads are unwound ends of the light unit. However, it is also possible to use separate inner current leads with a diameter that differs in comparison to the wire of the light unit.

The safety arrangement described here operates differently than those devices previously known, in that for the most part even within the first half-wave after the arc has formed, the operating conditions go below those necessary for the further existence of the arc. The arc that is produced once is extinguished so quickly that a heating of the foils and the pinched seal is barely detectable. The increase in temperature amounts to no more than 5° C.

A deciding advantage is the fact that an external safety device, which is usually integrated in the base can be definitively dispensed with. In this way, the structural length of such lamps can be greatly reduced (by approximately 25%). Also, the cost savings due to dispensing with the safety device are considerable. Previous designs of (inherent) safety devices were not so well developed, so that for reasons of safety, another safety device was used externally in the base.

In the case of a one-sided pinched lamp, the lighting unit may be formed in a U, V, or W shape. In a first form of embodiment, both inner current leads are present as unwound segments. In a second form of embodiment, only one of the two current leads can be an unwound wire segment. In particular, this form of embodiment can be wound onto a one-sided pinched lamp with axial light unit, which for the most part operates at mains voltages of approximately 110 V. Only the end of the light unit adjacent to the pinch seal is advantageously connected here with the sealing foil by means of a current lead in the form of an unwound segment. The other current lead, which is guided as a frame wire to the end away from the pinch seal is a thick wire.

In a particularly preferred form of embodiment, the light unit is subdivided into several illuminating segments, which are each separated by non-illuminating segments.

Under the term quartz glass will preferably be understood quartz glass with a $SiO_2$ content of at least 94 wt. % (e.g., Vycor).

In the lamp of the invention, the lighting unit is preferably held by heat-stable holding means, which can produce an arc, for example, a thick wire frame or glass crosspiece, which are formed from the material of the bulb.

The lamp according to the invention can be produced in a cost-favorable manner, since fewer structural parts are required, and the production can be particularly well automated.

Overall, a halogen bulb with a long service life (2000 hours) for general lighting is presented, which is characterized by an improved operating safety and a compactness that was not obtained by the prior art.

The lamp according to the invention is suitable for direct operation at the mains voltage, under which will be understood a range of approximately 80 V to 250 V. It is provided with a suitable base. For example, it may be equipped with a screw or pin or bayonet-type base. Typical wattage steps are from 25 to 150 W. For purposes of general lighting, the one-sided pinched lamp can be surrounded by an outer bulb. Due to its compactness, this lamp, however, can be utilized also advantageously in reflectors (e.g., PAR lamps, aluminum-evaporated reflector lamps, cold-light reflector lamps).

BRIEF DESCRIPTION OF THE DRAWINGS

The invention will be explained in more detail in the following on the basis of two examples of embodiment. Here.

BEST MODE FOR CARRYING OUT THE INVENTION

Figure 1:
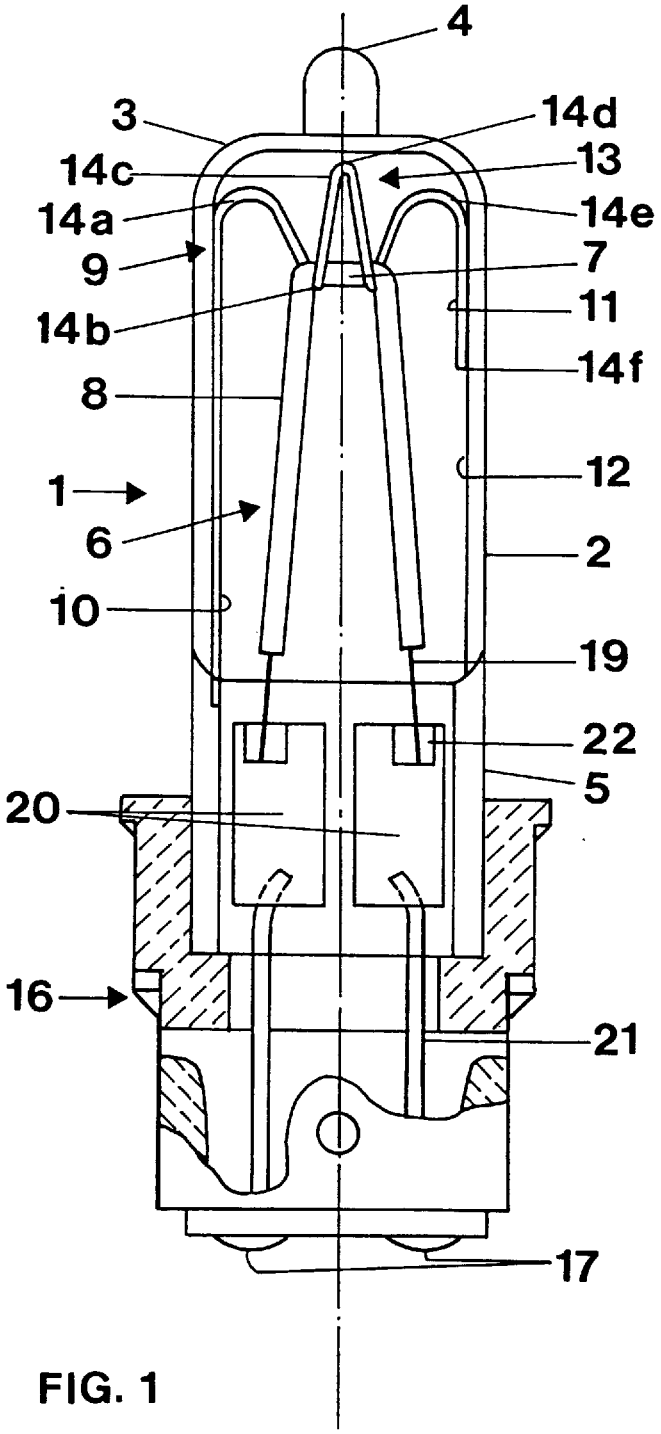
FIG. 1 shows a first example of embodiment of a high-volt halogen bulb.

FIG. 1 shows a halogen bulb 1 for general lighting purposes with a power of 75 W, which is suitable for direct connection to the 230 V mains. It has a cylindrical bulb 2 made of quartz glass with an outer diameter of approximately 12.5 mm with an inner diameter of 10.5 mm (with a tolerance of 0.8 mm) and a total length of approximately 60 mm (previously 86 mm). One end of bulb 2 is shaped into a cup 3, which has a pip 4 in the center. The other end of the bulb is sealed with a pinch seal 5, to which a bayonet mount 16 is attached. The bulb with a volume of 1.65 $cm^3$ is filled with an inert gas mixture of 80% Kr and 20% $N_2$, to which is added a halogen additive of 0.005% $CBrClF_2$. The maximum outer diameter of the lamp amounts to 18 mm.

A U-shaped bent light unit 6 made of tungsten, which is wound in a double manner throughout, extends over nearly the entire inner length of the bulb volume, whereby base part 7 of the "U", which extends crosswise to the lamp axis, is arranged in the vicinity of cup 3, whereas the two legs of the "U", which form the actual illuminating coil segments 8, extend from base part 7 to pinch seal 5 and in this way are slightly open to the outside at pinch seal 5. Lighting unit 6 is held by a frame 9, which is made of a support wire of tungsten with a diameter of approximately 280 $\mu$m. Frame 9 is essentially bent into a plane, which contains the lamp axis, in such a way that a cross section 13 extends between its two legs 10 and 11, which lie in an axis-parallel manner relative to each other and opposite inner wall 12 of the bulb, and this cross section 13 spans the inner diameter of the bulb. Other parts of the frame are designated with reference numbers 14*a* to 14*f*.

At their ends, the two illuminating coil segments 8 extend into short segments 19. At least one of the segments 19 comprises an uncoiled wire. These segments function as the inner current leads and are approximately 4 mm long. Inner current leads 19 are fused and sealed in pinch seal 5 over a length of 3 mm and are welded there to sealing foils 20 made of molybdenum. The wire diameter of the light unit and the current leads is 36 μm.

In order to facilitate welding, a region 22 of approximately 2×2 mm on each foil is tipped with a welding adjuvant (platinum paste). Current leads 19 project from the pinch seal only approximately 1 mm into the bulb volume.

Contact pins 21 are welded to the outer end of foils 20, and these project over the end of pinch seal 5 toward the outside and are joined with contact protuberances 17 on bayonet mount 16.

Figure 2:
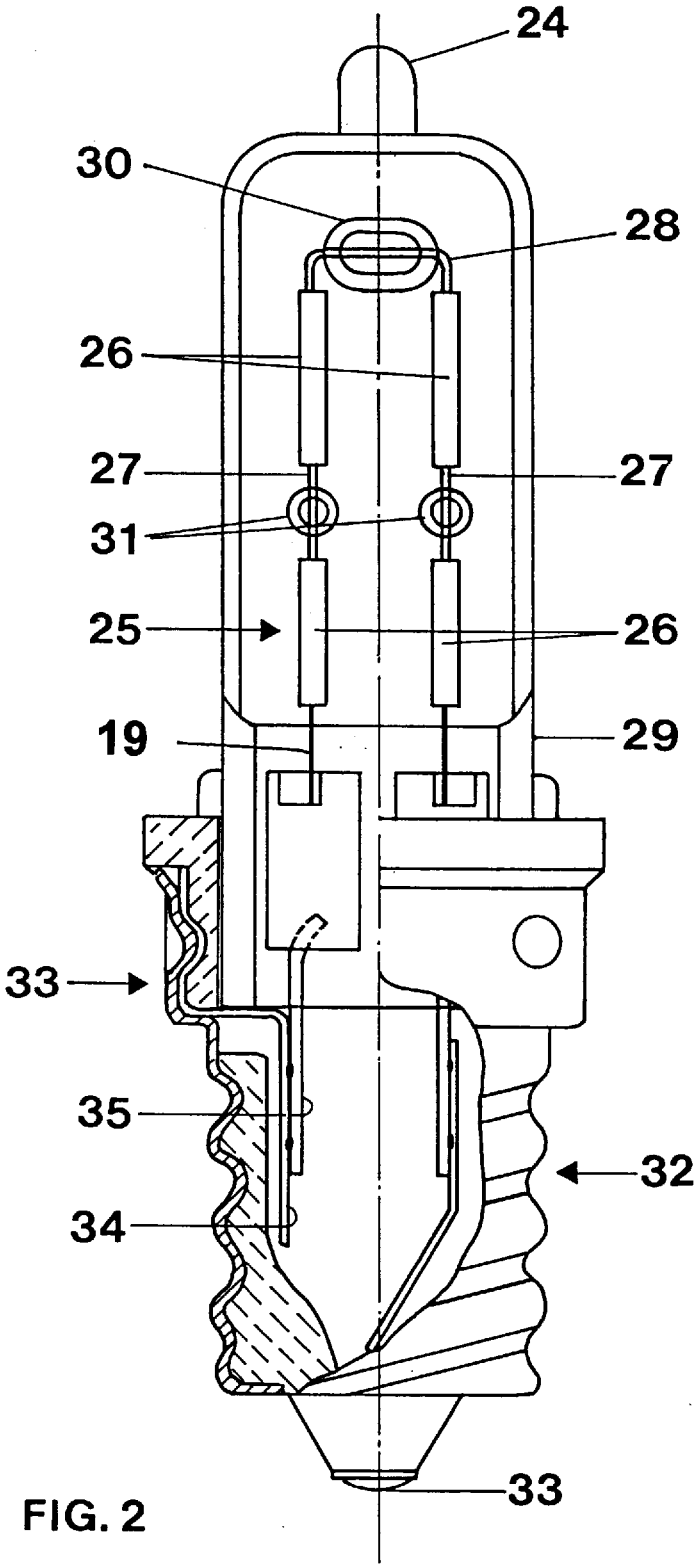
FIG. 2 shows a second example of embodiment of a halogen bulb.

In another example of embodiment (FIG. 2), whose structure essentially corresponds to the first example of embodiment, there is a 230-V lamp with a power between 25 and 60 W, whose total length amounts to 70 mm (instead of the earlier approximately 90 mm). Only the light unit, including the current leads, is dimensioned differently. The wire diameter amounts to approximately 15 to 45 μm, depending on the power. Light unit 25 is bent into a U shape. The two legs of the light unit guided parallel to the lamp axis are themselves subdivided again into two doubly wound illuminating segments 26, which are joined together by singly wound segments 27. In addition, the joining part 28 of the U is singly wound. This is arranged crosswise to the lamp axis in the vicinity of pip 24. Its ends are angled by 90° and each extends into a segment 26.

At the level of joining part 28, the light unit is attached by an oval glass crosspiece 30, which is formed from the material of the bulb. Joining part 28 is pinched in glass crosspiece 30. In addition, lighting unit 25 is attached in the region of the singly wound segments 27 by another glass crosspiece 31, which has a circularly shaped cross section.

A screw base 32 is attached to pinch seal 29 of the bulb, and the contact surfaces 33 of this base are joined with the outer contact pins 35 of the bulb in a known way, but without intermediately connected safety devices, by means of lead wires 34.

Comparative tests between the lamps (A) of the invention, lamps with slinky hollow space (B1) as well as lamps (B2) with thick current leads (diameter of 280 μm) show the following differences:

The current intensity in the arc is limited according to the invention (A) to 60 A compared with the previous 600 A (B2) or 70 A (B1).

The duration of the arc is now reduced to approximately 1 ms, in comparison to the previous 3 ms (B1) or 25 ms (B2).

The energy uptake is now limited to approximately 1 mWs in comparison to the previous 5 mWs (B1) or 2700 mWs (B2).

The increase in temperature on the foil amounts to only 5 K (A) in comparison to 20 K (B1) or more than 1000 K (B2).

The effectiveness of the measures according to the invention is particularly underscored in a meaningful way by the fact that when a 75 W/12 W bulb was forcibly operated in an erroneous manner on a 220 V mains, the arc was reliably extinguished and no explosion of the bulb occurred.

Overall, the arrangement according to the invention results in a greater reliability, a shorter response time, and a simpler as well as a more cost-favorable production in the case of one-sided pinched halogen bulbs for intermediate-volt and high-volt operation.

Figure 3:
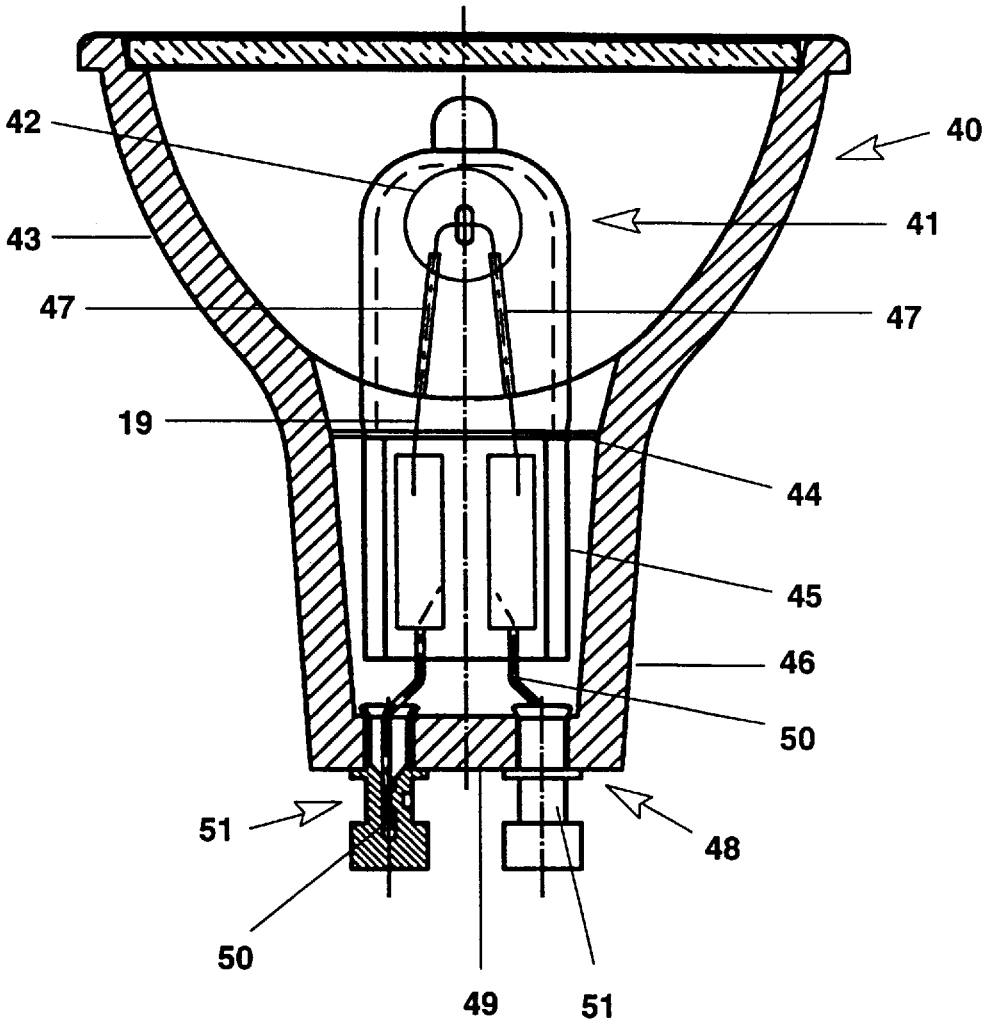
FIG. 3 shows a third example of embodiment of a reflector lamp.

FIG. 3 shows a reflector lamp 40 with an operating voltage of 230 V and a power of 50 W. The incorporated lamp 41 itself is structured as in FIG. 2. It has an outer diameter of approximately 13 mm. For a better compact arrangement, it has only one single glass crosspiece 42, which sits in the region of the bulb cup. In this way it reaches a structural length of only 38 mm, calculated from the pinch seal to the pip. The lamp can thus be accommodated in a very compact reflector 43 made of glass with an outer diameter of 50 mm. A perforated disk 44 of metal sheet at the level of the piece of pinch seal 45 serves for better attachment.

The reflector tapers toward reflector neck 46 to an outer diameter of 20 mm. Its entire length is 49 mm. Also, the indicated coil design operates with two short parallel legs 47, which stand next to each other, advantageously for the light distribution in the reflector. The dimensions of the two coil legs are approximately 0.5×9.5 mm.

Whereas in conventional reflector lamps (without inherent safety devices) there is usually introduced an intermediate piece (of ceramics) incorporated between the reflector skirt and the base, in which a safety device is accommodated; this can be dispensed with here. Previously, this intermediate piece had to be cemented into the reflector. Accordingly, a base cement can now be completely dispensed with.

The reflector lamp has a glass base 48 directly formed on the reflector neck for a further shortening of the structural length. This base essentially comprises a planar end surface 49 at the end of the reflector neck. The outer current leads 50 of the incorporated lamp are guided to the outside through two openings and crimped in two contact pin sockets 51. Contact pin sockets are themselves riveted in the openings. The principle of this glass base is similar to the glass base described in DE-GM (Utility model) 82-34,509.

In another example of embodiment, this reflector bulb has a conventional screw base or bayonet mount instead of the glass base.

The example of embodiment of FIG. 3 has special advantages when compared with known reflector lamps, since both the number of structural parts (now there are six parts, and earlier there were ten structural parts including the intermediate piece) can be considerably reduced and the assembly procedure can be considerably simplified. The new product may be produced in an essentially more cost favorable and time-saving manner.

Also due to the inherent safety device, the covering disk can be dispensed with, if the quartz glass is doped in a way known in and of itself, in order to assure the necessary UV protection.

The invention is not limited to the examples of embodiment that are shown. In particular, it is also suitable for halogen bulbs for mains operation at 110 V. Further, the two coil segments can be divided once more. The impact strength of the light unit can be further improved by additional measures. The filling may also comprise other components known in and of themselves, e.g., $CH_2Br_2$ can be used as the halogen addition. Also, for the mounting frame of wire, tube-shaped holders of quartz glass (glass crosspieces), which are formed from the material of the bulb, may be used for attaching the light unit.

In another example of embodiment, the light unit is axially arranged, and the current lead, which leads to this end on the side of the pinch is fused into the pinch seal as an uncoiled segment.

A price-favorable halogen bulb with a low power consumption of up to 25 W for direct mains connection is made available with the invention, and this is of particular interest for all-purpose lighting. Preferred power steps lie at a maximum of 250 W.

The invention is particularly advantageous for one-sided pinched halogen bulbs with low power (25 to 75 W), since here the space-saving effect of the invention is best applied, with the use of a glass or bayonet mount.

We claim:

1. Halogen bulb (1) with a base on one side for operation with alternating frequency on mains voltage, with the following features:

a bulb (2) of quartz glass hermetically sealed by a single pinch seal (5), a base (16:32), which is attached to the pinch seal, a filling of inert gas and a halogen-containing addition, a light unit (6; 25) with two ends;

a current input system, which provides an electrical input for light unit (6), the current input system comprises inner current leads (19), which join the ends of the light unit with sealing foils (20) embedded in pinch seal (5; 29) and which are embedded over a part of their length in the pinch seal, whereby at least one of the current leads (19) comprises an uncoiled wire, is hereby characterized by the fact that an inherent safety effect is produced by the fact that at least one of the two inner current leads (19) is produced from a wire with a diameter of 130 $\mu$m at most, which is embedded by a length of at least 2 mm in pinch seal (5; 29), whereby a distance between the current leads and the applied voltage V interact in such a way that if an arcing occurs between the current leads, the field intensity operating there is greater than 100 V/cm.

2. Halogen bulb according to claim 1, further characterized in that light unit (6) is bent into a U, W, or V shape and both current leads (19) are arranged approximately parallel and are sealed in the pinch seal at a distance of at least 5 mm.

3. Halogen bulb according to claim 1, further characterized in that light unit (6) comprises several illuminating segments (26), which are set apart by non-illuminating segments (27).

4. Halogen bulb according to claim 1, further characterized in that at least one heat-stable holding means (9; 30, 31) attaches to the light unit.

5. Halogen bulb according to claim 1, further characterized in that light unit (6) is axially arranged, and the current lead, which leads to its end on the side of the pinch seal, is fused in the pinch seal as the uncoiled wire.

6. Halogen bulb according to claim 1, further characterized in that light unit (6) and inner current leads (19) are produced from a single wire.

7. Halogen bulb according to claim 1, further characterized in that the base is a bayonet mount (16).

8. Halogen bulb according to claim 1, further characterized in that the entire structural length of the lamp is smaller than or equal to 75 mm.

9. Halogen bulb according to claim 1, further characterized in that the lamp is a reflector lamp.

10. Halogen bulb according to claim 9, further characterized in that the reflector lamp has a reflector contour with a shaped glass base.

* * * * *